US006113232A

United States Patent [19]

Belon et al.

[11] Patent Number: 6,113,232

[45] Date of Patent: Sep. 5, 2000

[54] STATIONARY PEN PRINTER

[75] Inventors: Juan B. Belon, San Diego; David M. Petersen, Poway, both of Calif.

[73] Assignee: Hewlett-Packard Company, Palo Alto, Calif.

[21] Appl. No.: 08/995,745

[22] Filed: Dec. 19, 1997

[51] Int. Cl.[7] ..... B41J 2/01

[52] U.S. Cl. ..... 347/104

[58] Field of Search ..... 33/1; 271/225, 271/230, 240, 255; 346/139; 347/102, 104, 106

[56] References Cited

U.S. PATENT DOCUMENTS

| | | | |
|---|---|---|---|
| 4,233,740 | 11/1980 | Bunn et al. | 33/1 |
| 4,357,619 | 11/1982 | Klockenbrink | 346/160 |
| 4,547,786 | 10/1985 | Logan et al. | 346/140 |
| 4,823,148 | 4/1989 | Sieber et al. | 346/139 |
| 4,905,015 | 2/1990 | Sieber et al. | 346/1.1 |
| 5,019,004 | 5/1991 | Steiner et al. | 445/30 |
| 5,172,138 | 12/1992 | Okazawa et al. | 346/134 |
| 5,216,442 | 6/1993 | Parks et al. . | |
| 5,277,140 | 1/1994 | Nakagaki | 112/121.12 |
| 5,323,722 | 6/1994 | Goto et al. | 112/121.2 |
| 5,333,561 | 8/1994 | Katou | 112/121.14 |
| 5,357,859 | 10/1994 | Eckert | 101/228 |
| 5,480,132 | 1/1996 | Kiyohara et al. | 271/10.01 |

*Primary Examiner*—Arthur T. Grimley
*Assistant Examiner*—Hoang Ngo
*Attorney, Agent, or Firm*—Jerry R. Potts

[57] ABSTRACT

A device for printing comprising a stationary inkjet-style pen, two stationary motors and a paper holder movable on two axes, a slew axis and an advance axis, wherein the paper is moved into the proper position for each step in the printing process by the paper holder and the two motors.

19 Claims, 5 Drawing Sheets

STATIONARY PEN PRINTER

TECHNICAL FIELD

The invention relates to generally to serial printers, and more specifically to media handling mechanisms for swath-oriented printers such as inkjet printers.

BACKGROUND OF THE INVENTION

Inkjet style printers typically utilize one or more pens held in a carriage that moves across the paper from side-to-side, with each pen having multiple nozzles organized as a vertical array, and an advance or "slew" mechanism, for advancing a sheet of paper (or other appropriate ink-receiving medium) beneath the pen (i.e., from top to bottom). Thus the advance mechanism moves the paper to the proper line, and the inkjet pen then moves laterally across the paper into position to print a band or swath whose height is limited by the vertical dimension of the nozzle array, and whose width is determined by the corresponding dimension of the sheet. After the selected nozzles are "fired," creating a single column of dots ("pixels") of ink, the pen continues in its lateral movement across the width of the sheet until it reaches the position where the next dot of ink is required. To avoid pixels "running together" ink may be applied to adjacent pixels in separate passes, allowing the first to at least partly dry before the second or subsequent pixels are created. Once the current swath is completed, the advance mechanism moves the page such that the lateral path of the pen is lower in the page and the process is repeated until the page is printed.

The known prior art designs require that the printer housing be large enough to accommodate the lateral movement of the pen, thereby establishing minimum dimensions for both the volume and the "footprint" (e.g the area occupied by the cabinet). Furthermore, multi-lead flexible cables typically provide power and control signals to the moving pen from a fixed power supply and control circuitry inside the housing, adding to the cost and complexity of the printer and potentially resulting in undesirable radio frequency interference. Also, the moving pen must either be connected to a remote reservoir of ink (thereby adding further cost and complexity) or the pen must contain a built-in ink reservoir (which increases the moving mass and therefore consumes additional power). Space and power consumption are of particular concern for portable applications, as a smaller and less costly device is understandably preferred.

SUMMARY OF THE INVENTION

The present invention provides a device for printing with an inkjet style pen in which the pen remains stationary relative to a housing, while a paper is moved on two axes under the pen, and the paper can move outside of the housing to keep the volume and footprint of the housing to a minimum. A tracking system is also provided to insure that printing takes place in the correct portion of the paper.

In a first embodiment, the present invention provides a printer for printing an image on a sheet of a print medium, the print medium having an image surface on which the image may be formed, the printer comprising a housing, at least one pen having a tip responsive to a first control signal for forming at least one image pixel on an adjacent pixel location of the image surface, a pen holder for holding said pen inside the housing with said tip in a fixed position relative to the housing, a print medium holder at least partially inside the housing for movably holding said medium with different portions of said surface adjacent said tip, at least one motor responsive to a second control signal and mechanically coupled to the print medium holder for moving said medium on two orthogonal axes relative to said tip; and a controller coupled to said pen and to said motor for supplying said first and second control signals to thereby form said image.

In other embodiments, the present invention provides a printer wherein the stationary pen is an ink jet style pen with an array of nozzle jets arranged to print a swath of pixels perpendicular to the slew axis; the print medium extends outside the housing in the direction of the slew axis, the nozzle array is perpendicular to the slew axis, a reservoir portion of the ink jet pen has a minor axis parallel to the slew axis, and a maximum travel along the slew axis is greater than a corresponding maximum along the minor axis; said at least one motor is maintained in a stationary position relative to said housing; said at least one motor, said controller and said pen holder are contained completely inside the housing; the at least one motor further comprises two motors, a swath motor and a slew motor, each having separate tracking means for tracking the position of the paper relative to the pen; the tracking means comprises a swath tracking surface, which is interconnected to the swath motor and has readable positioning marks, a swath sensor for reading the readable positioning marks and transmitting such to the controller, a slew tracking surface, which is interconnected to the slew motor and has readable positioning marks, and a slew sensor for reading the readable positioning marks and transmitting such to the controller; the print medium holder further comprises a paper holding crimp securing a removable edge of the print medium or the print medium holder further comprises at least one set of opposing rollers, said rollers being pivotally mounted to the case.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION

Figure 1:
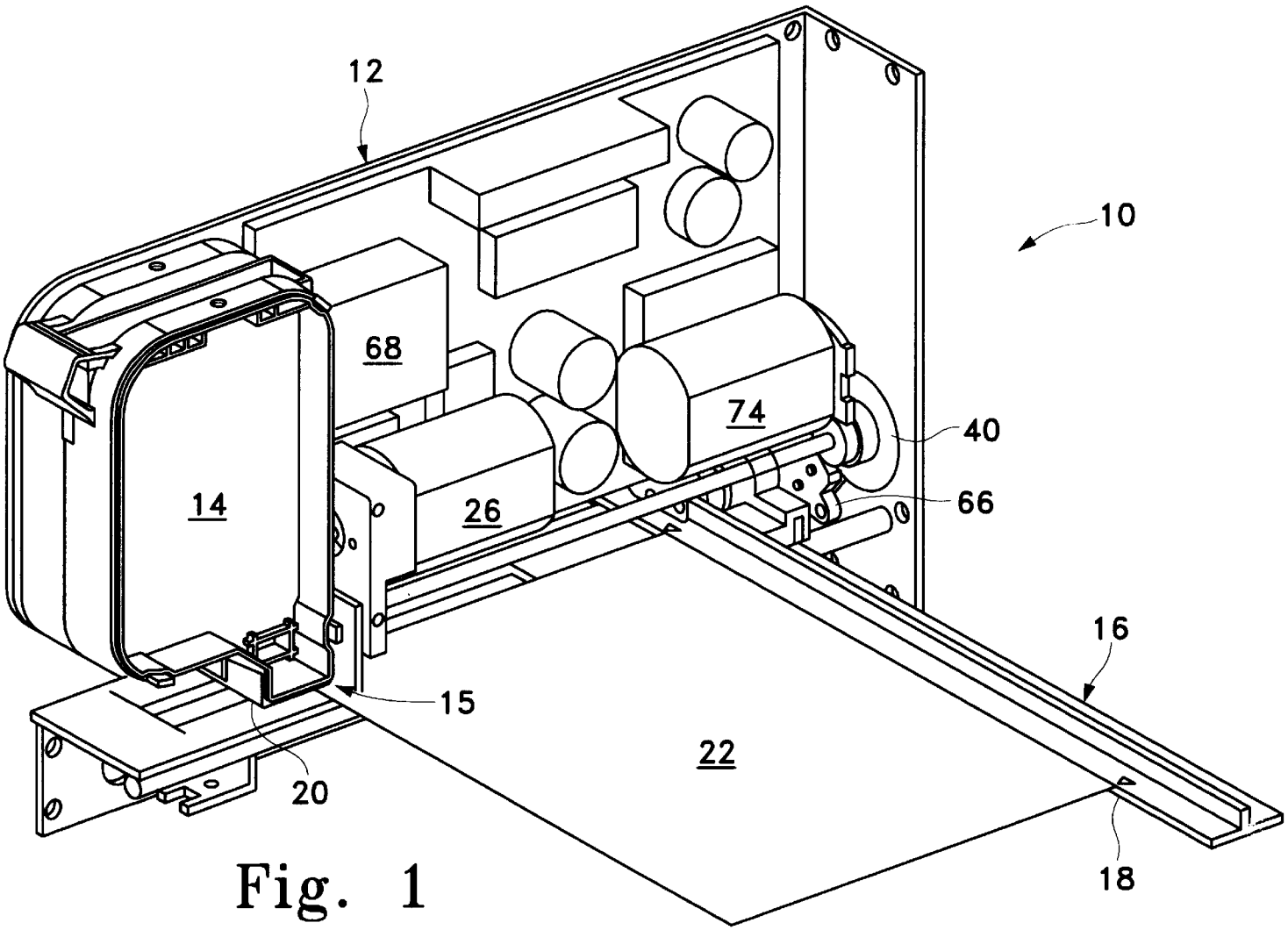
FIG. 1 is an isometric view of the interior of a preferred embodiment of the present invention.

FIG. 1 shows a stationary pen printer 10 constructed according to the present invention. A housing 12 includes a pen 14 for printing on a print medium, such as, in a preferred embodiment, a piece of paper 22, said pen 14 being mounted in a stationary relationship to the housing 12 and contained a predetermined distance from the paper 22 by a pen holder (not shown) such as the pen holder described in U.S. Pat. No. 5,392,063. The stationary pen printer 10 can use a commercially available pen 14, such as the HP C1816A, a three color pen (other commercially available pens suitable for use in the present invention range from four color pens to simple black and white units. The pen 14 has a nozzle mechanism 20 for expelling ink onto the paper 22. Typically, the pen is mounted perpendicular to the direction of print across a page. Because it is stationary, the pen 14 may be directly connected to the circuitry of the stationary pen printer 10 without the use of a flexible multi-lead cable (which would be required for a moving pen).

Figure 2:
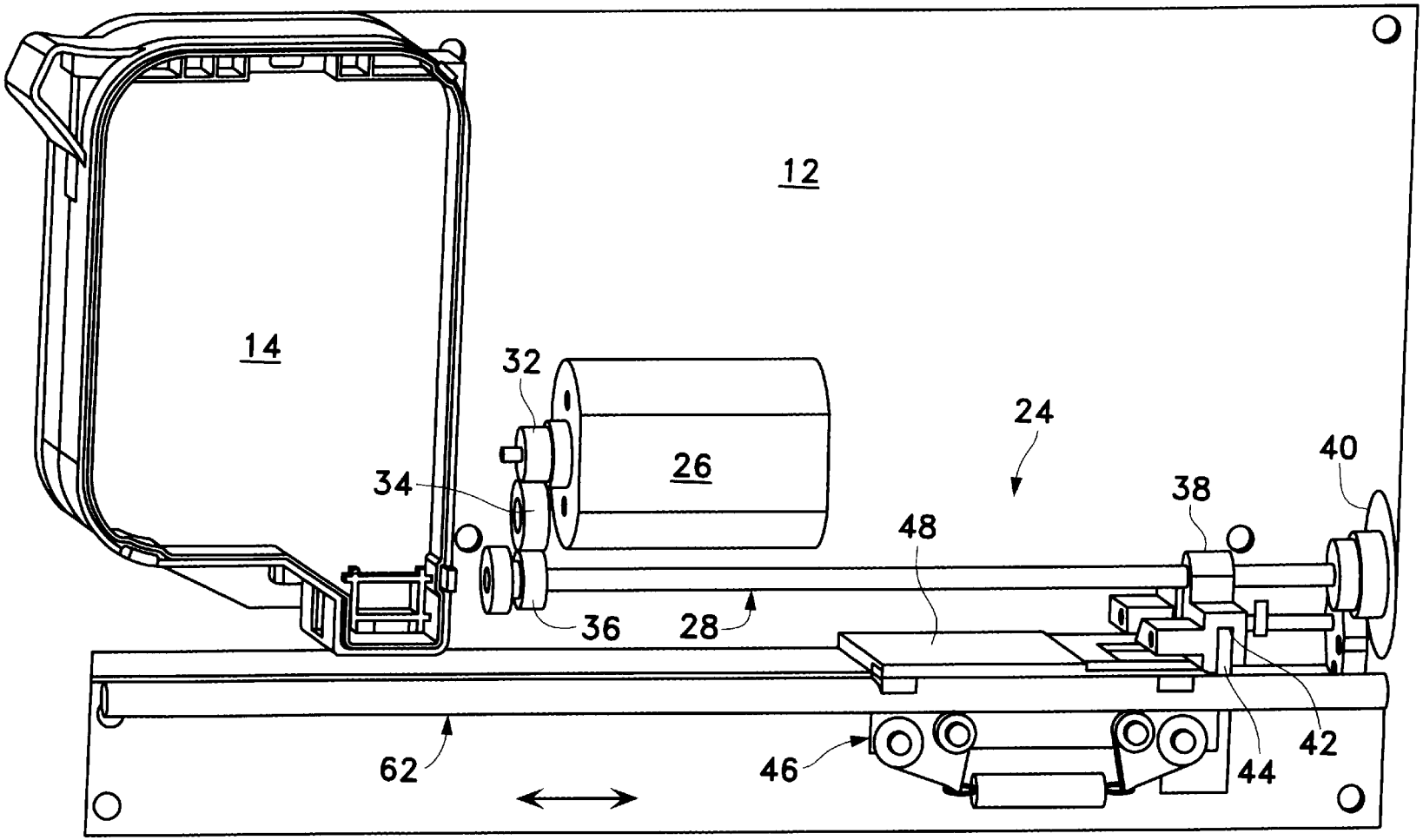
FIG. 2 is a side isometric view of the advance mechanism a preferred embodiment of the present invention.
Figure 3:
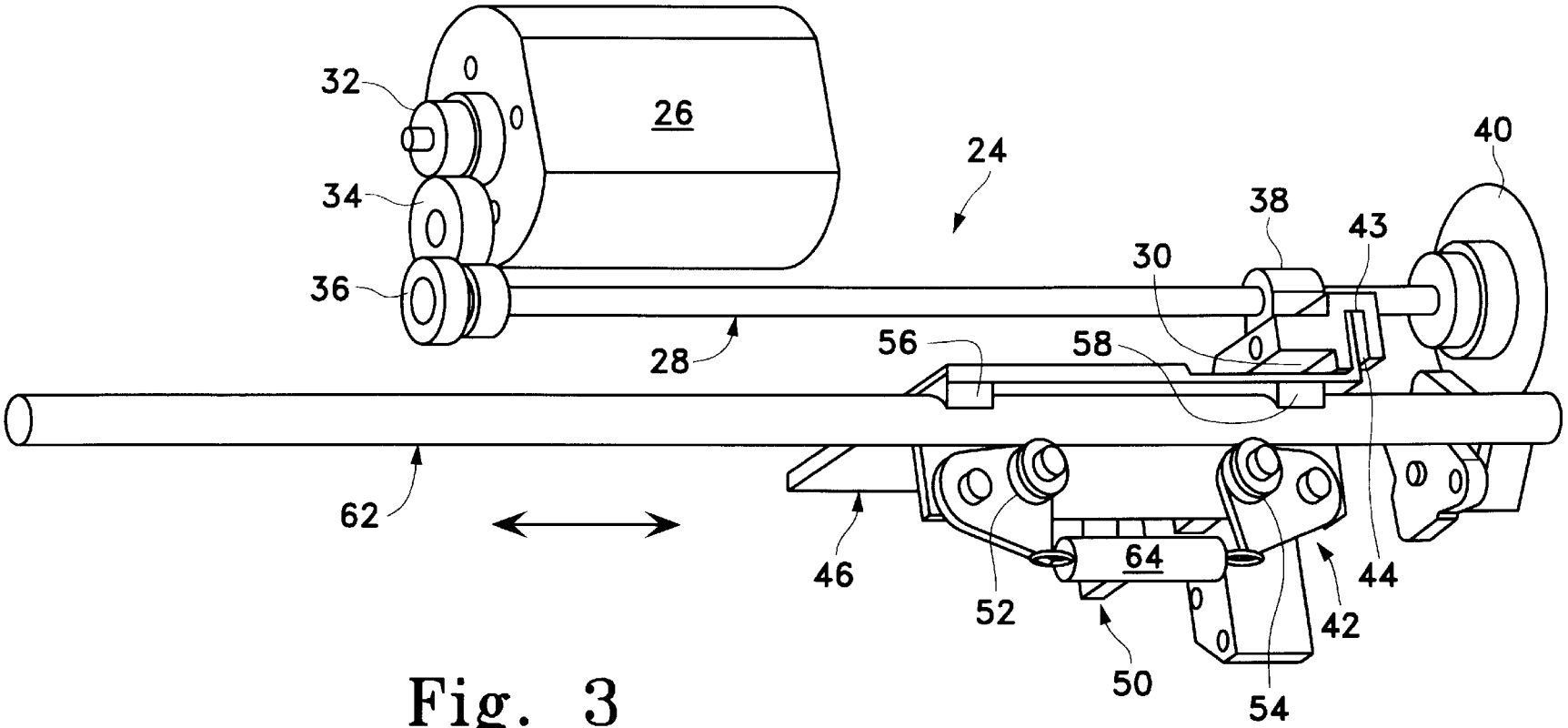
FIG. 3 is an isometric view of the pen and the advance motor and mechanism of FIG. 2.

The housing 12 also has a paper holding means, which can take any number of forms, such as a set of opposing rollers or a pallet supporting the underside of the paper. In a preferred embodiment, it includes a paper guide strip 16, which has on one side a paper holding crimp 18 for holding the paper 22 which may have a removable border edge (not shown) to allow printing on the entire surface of the paper 22. Mechanisms automatically feeding paper from a stack may also be employed. The housing 12 has a gap 15 between a nozzle mechanism 20 end of the pen 14 and the housing 12, which extends laterally to enclose the paper guide strip 16, allowing all parts to the paper 22 to move beneath the nozzle mechanism 20 with parts of the paper 22 and paper guide strip 16 extending outside the housing 12. This movement of the paper 22 outside the housing 12 significantly reduces the required size and footprint of the housing 12, as it does not have to be large enough to enclose the entire paper 22, as do prior art devices (which also have to provide even more room within their cases to allow for the dimensions of the pen on both ends of the paper). Referring to FIGS. 1, 2 and 3, also mounted to the housing 12 is a "swath" or advance mechanism 24 for moving the paper guide strip 16 (and thus the paper 22) in the direction shown by the arrows in FIGS. 2 and 3 (i.e., the paper guide strip 16 moving towards and away from the pen 14). Although different embodiments may print on this, the advance axis of movement, or on both the advance axis and the slew axis (discussed below), in a preferred embodiment the printing is done only during the slew axis, as fully described below (an advance axis may be compared to the carriage return in a mechanical typewriter, and the slew axis to the cross-wise movement during the typing process).

The advance mechanism 24 includes a motor means, which can take any of a number of forms, such as a single motor powering movement in both the advance axis and the slew axis (see below), or separate motors powering each axis. In a preferred embodiment, the advance mechanism 24 has a dedicated motor, such as advance motor 26 which is connected to a threaded shaft 28 via one or more gears, such as gear 32, gear 34 and gear 36. The threaded shaft 28 is connected to gear 36 at one end, passes through a threaded spring loaded nut 38 and is connected at its other end to an advance code wheel 40. The threaded spring loaded nut 38 surrounds the threaded shaft 28 and forms a cavity 42 though which a paper advance flange 44 of a paper carriage 46 passes. The paper carriage 46 also includes an upper surface 48 for supporting a portion of the paper 22, and a preloaded plastic bushing system 50, located beneath the paper carriage 46. The preloaded plastic bushing system 50 includes one or more wheels, such as wheel 52 and wheel 54 and corresponding and opposing plastic bushings, such as plastic bushing 56 and plastic bushing 58. Located between wheel 52 and plastic bushing 56, and between wheel 54 and plastic bushing 58 is a rigid guide way 62. A spring 64 urges wheel 52 and wheel 54 against the rigid guide way 62 which is thus secured between wheel 52 and wheel 54 on the one hand, and plastic bushing 56 and plastic bushing 58 on the other hand.

The advance mechanism 24 also includes a code and sensor means for locating the exact position of the paper guide strip 16. The code and sensor means can take any number of forms, such as magnetic codes, tactile markings or optical codes, perhaps located on a stationary part, such as rigid guide way 62, and a sensor located on a moving part, such as the paper carriage paper carriage 46. In a preferred embodiment, a stationary advance optical sensor 66 for reading the codes on the advance code wheel 40 and transmitting that information electronically to a controller means 68 (FIG. 1) is provided.

The threaded spring loaded nut 38 and upper surface 48 form a recess 30 through which the paper guide strip 16 passes, such that movement of the threaded spring loaded nut 38 and the upper surface 48 in the direction of the advance axis (see arrows on FIGS. 2 and 3) will cause the paper guide strip 16 to be pulled by the recess 30 in the same direction, and to move relative to the pen 14 but not to the threaded spring loaded nut 38 and upper surface 48. However, as discussed below, the paper guide strip 16 may pass through the recess 30 back and forth in the direction of the slew axis (see arrows on FIG. 4).

Thus the advance mechanism 24 moves the paper 22 in the following manner. The controller means 68 senses the position of the paper guide strip 16 and the paper 22 along the advance axis by the position signal from the advance optical sensor 66, and determines in which direction the advance mechanism 24 should advance the paper 22. The controller means 68 then sends a control signal to the advance motor 26 which turns the threaded shaft 28 via gears, such as gear 32, gear 34 and gear 36. The threaded shaft 28 in turn rotates through the threaded spring loaded nut 38, and the threads of the threaded shaft 28 engage the threads of the threaded spring loaded nut 38 urging the threaded spring loaded nut 38 laterally along the length of the threaded shaft 28, the direction depending upon the rotational direction of the advance motor 26.

Figure 4:
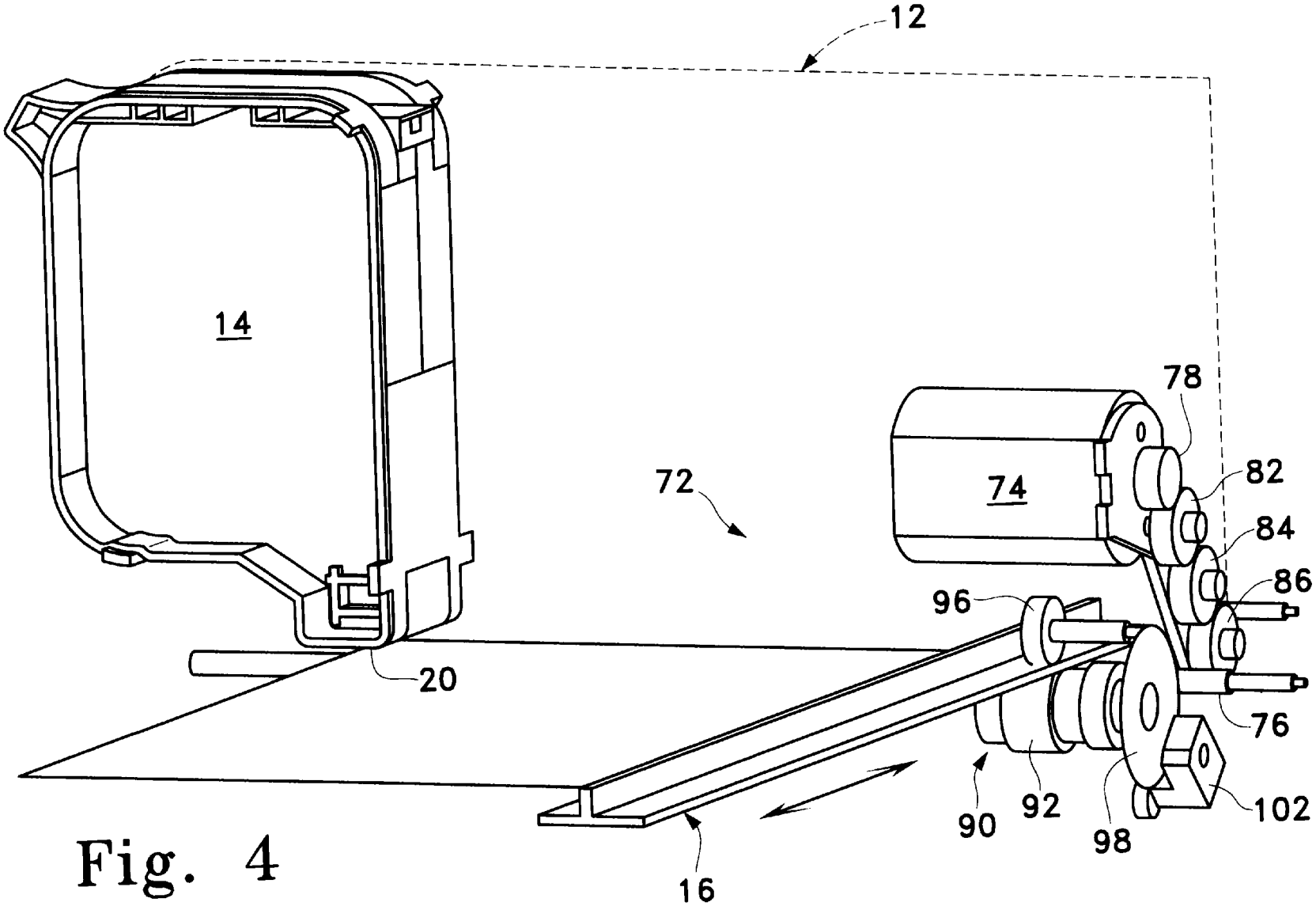
FIG. 4 is an isometric view of the swath mechanism of a preferred embodiment of the present invention.
Figure 5:
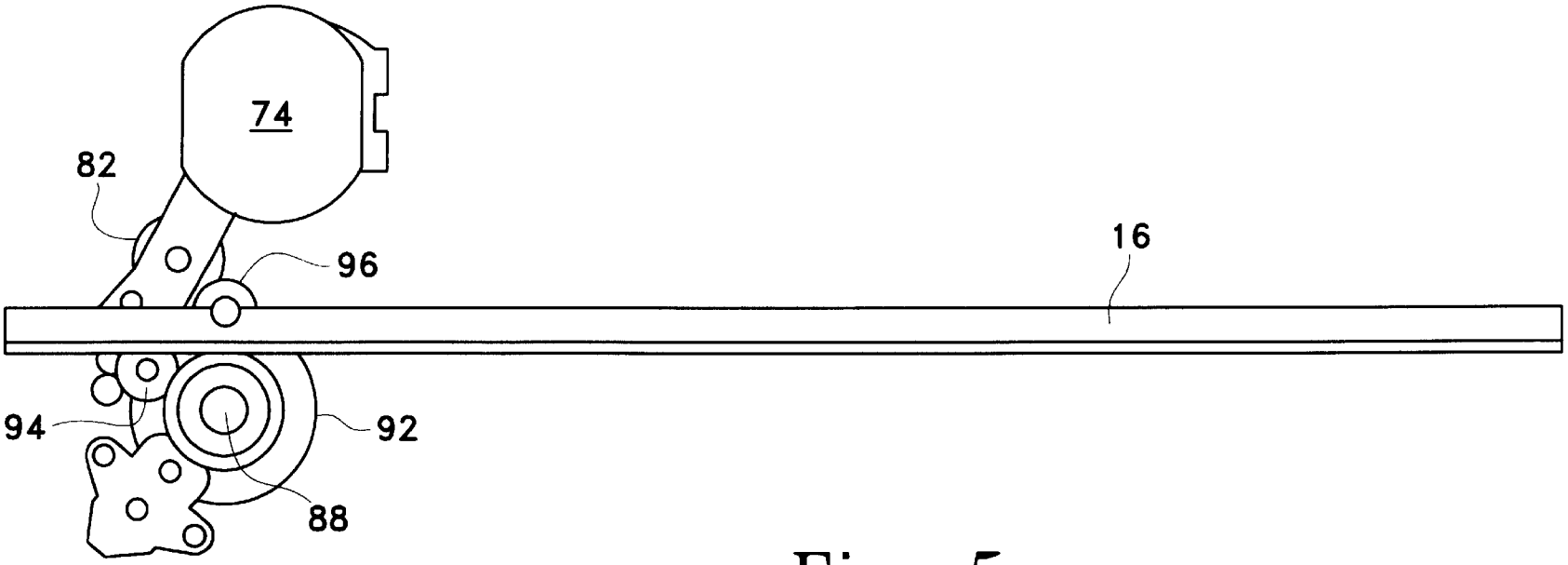
FIG. 5 is a side elevational view of the swath axis of a preferred embodiment of the present invention.

Referring to FIGS. 4 and 5, a slew mechanism 72 is provided for moving the paper guide strip 16 (and thus the paper 22) in the direction shown by the arrows in FIG. 4 (i.e., the paper guide strip 16 moving back and forth while maintaining a constant distance from the pen 14). As noted above, in different embodiments printing may occur during the advance axis of movement, the slew axis of movement, or both. However, in a preferred embodiment the printing is done only during the slew axis.

The slew mechanism 72 includes a motor means, which can take any of a number of forms, such as a single motor powering movement in both the advance axis and the slew axis, or separate motors powering each axis. In a preferred embodiment, the slew mechanism 72 has a dedicated motor, such as slew motor 74, which is connected to a transmission shaft 76 via a series of gears (or rollers), such as gear 78, gear 82, gear 84 and gear 86. The slew mechanism 72 is connected to the housing 12 (shown in relief). A guide shaft 88 is mounted to the housing 12, and passes through a sliding gear assembly 90. The sliding gear assembly 90 includes a driven gear 92, a gear 94, and a stabilizing gear 96.

The slew mechanism 72 also includes a code and sensor means for locating the exact position of the paper guide strip 16. As with the code and sensor means of the advance mechanism 24, the slew mechanism code and sensor means can take any number of forms, such as magnetic codes, tactile markings or optical codes, perhaps located on paper guide strip 16, and a sensor located on the sliding gear assembly 90. In a preferred embodiment, a slew optical sensor 102 for reading the codes on a slew code wheel 98 and transmitting that information electronically to a controller means 68 (FIG. 1) is provided.

The sliding gear assembly 90 moves the paper guide strip 16 and the paper 22 in the direction shown by the arrows on FIG. 4. The slew motor 74 turns the transmission shaft 76 via gears, such as gear 78, gear 82, and gear 84. The transmission shaft 76 in turn rotates against and turns the gear 94 which in turn rotates the driven gear 92. The driven gear 92 rotates against and moves the underside of the paper guide strip 16 (and thus the paper 22), while the upperside of the paper guide strip 16 is restrained by the stabilizing gear 96. The driven gear 92 and the stabilizing gear 96 can be urged towards the paper guide strip 16 in any number of ways, such as having a spring (not shown). Thus the sliding gear assembly 90 moves the paper guide strip 16 inwards and outwards in the direction of the arrows on FIG. 4. At the same time, the slew optical sensor 102 senses the position of the paper guide strip 16 relative to the sliding gear assembly 90 by reading the marks on the slew code wheel 98, and transmits that position to the controller means (FIG. 1). The controller means 68 then sends a control signal to the slew mechanism 72 to appropriately move the paper guide strip paper guide strip 16 and the paper 22 by activating the slew motor 74, which will rotate the gear 78, gear 82, gear 84 and gear 86, which in turn rotates transmission shaft transmission shaft 76 which transmits such rotational movement to gear 94 which rotates driven gear 92, thus moving paper guide strip 16 and paper 22. The sliding gear assembly 90 will move with the paper guide strip 16 when the advance mechanism 24 moves the paper guide strip 16 towards the pen 14, with the gear 94 still transmitting rotational movement from the transmission shaft 76 to the driven gear 92.

In operation, the user will load paper 22 into the stationary pen printer 10. This may be done in any number of ways, such as an automatic paper feeding mechanism or manual feeding. The paper 22 may be secured to the stationary pen printer 10, also in a variety of ways, such as using a curved palette, utilizing thick paper, or in a preferred embodiment, the paper 22 is secured to the paper guide strip 16 by crimping an edge into the paper holding crimp 18. The stationary pen printer 10 is connected to a device transmitting an stored or "real time" digital image from an image generating device, such as a computer or camera (not shown), which will transmit an image to the stationary pen printer 10 according to established protocols. The controller means 68 receives inputs from the slew optical sensor 102 and the advance optical sensor 66 giving the location of the paper 22 on two axes, the advance axis (noted by the arrows on FIGS. 2 and 3), and the slew axis (noted by the arrows on FIG. 4). In response to such inputs and to the electronically stored image, the controller means 68 moves the paper into the proper position for printing, and prints the image, as follows. The controller means 68 determines the position of the paper based upon the signals from the advance optical sensor 66 and slew optical sensor 102. If the paper 22 is not in the proper position for the printing operation, the controller means 68 will first determine how much movement is required on both the advance and slew axes. In a preferred embodiment, if movement is required on both axes, the advance axis will be positioned first. The controller means 68 will order the advance motor 26 to rotate in the appropriate direction, which will turn gear 32, gear 34, and gear 36, which will rotate threaded shaft 28. Threaded shaft 28 will then urge threaded spring loaded nut 38 towards or away from the pen 14. Threaded spring loaded nut 38 urges the paper advance flange 44 and thus the paper carriage 46 in the same direction. Recess 30 surrounds the paper guide strip 16 and urges it also in that same direction, with the paper guide strip 16 perpendicular to the line of travel. The controller means 68 continuously monitors input from the advance optical sensor 66 and stops movement of the advance motor 26 when such input indicates that the paper guide strip 16 and paper 22 are in the proper position for printing. The controller means 68 then begins the printing process by making one or more printing passes on the slew axis by first positioning print media relative to the pen 14 by signaling the slew motor 74 to move the paper guide strip 16 into the proper position, and by monitoring that position via the slew code wheel 98 and the slew optical sensor 102. Once the paper guide strip 16 (and the paper 22) is in the proper position, the controller means 68 orders the pen 14 to print via its nozzle mechanism 20. Once the nozzle mechanism 20 is activated, the controller means 68 orders the slew motor 74 to move the paper guide strip 16 into the next position required for printing. Known techniques can be employed to maintain the paper 22 at an optimal distance from the nozzle mechanism 20, such as providing grids and stops in the vicinity of the nozzle mechanism 20, or by the inherent properties of the paper 22 (e.g., the thickness of the paper). When all printing on a given advance axis position is completed, the controller means 68 then moves the paper 22 on the advance axis, as described above, and the process repeats itself until an entire page is printed.

Having now described the invention in accordance with the requirements of the patent statutes, those skilled in the art will understand how to make changes and modifications in the present invention to meet their specific requirements or conditions. Such changes and modifications may be made without departing from the scope and spirit of the invention as set forth in the following claims.

What is claimed is:

1. A serial printer for printing an image on a sheet of a print medium, the print medium having an image surface on which the image may be formed, the image comprising successive swaths of pixels collectively disposed along an advance axis, each of the swaths being oriented parallel to a slew axis orthogonal to the advance axis, the printer comprising:

an external housing;

at least one stationary pen having a printhead array of pixel forming elements responsive to a first control signal for forming a corresponding printed array of pixels aligned substantially perpendicular to the slew axis on an adjacent portion of the image surface;

a stationary pen holder for holding said pen inside the housing with said printhead array in a fixed stationary position relative to said housing, a moveable print medium holder at least partially inside the housing for movably holding said medium with different said portions of said image surface adjacent said printhead array, such that said print medium extends outside the housing in the direction of the slew axis;

at least one motor inside the housing and responsive to a second control signal and mechanically coupled to the print medium holder for moving said print medium, relative to said housing, independently along both said slew axis and along said advance axis, such that a maximum travel of said print medium along said slew axis is greater than a first external dimension of said housing along said slew axis; and a controller inside the housing and coupled to said pen and to said motor for supplying said first and second control signals to thereby form said image.

2. The printer of claim 1 wherein the stationary pen is an ink jet pen with an array of nozzle jets parallel to the advance axis.

3. The printer of claim 1 wherein:

a reservoir portion of the ink jet pen has a major axis parallel to the advance axis and has a minor axis parallel to the slew axis, the external extent of the reservoir portion along said major axis being larger than the external extent of the reservoir portion along said minor axis; and a maximum travel of said print medium along said advance axis is less than a second external dimension of the housing along said advance axis;

whereby the volume of the housing is minimized for a predetermined printable area of print medium.

4. The printer of claim 3 wherein each said motor is maintained in a stationary position relative to said housing.

5. The printer of claim 1 wherein each said motor, said controller and said pen holder are all contained completely inside the housing.

6. A printer for printing an image on a sheet of a print medium, the print medium having an image surface on which the image may be formed, the image comprising successive swaths of pixels collectively disposed along an advance axis, each of the swaths being oriented parallel to a slew axis orthogonal to the advance axis, the printer comprising:

a housing;

at least jet pen having a printhead responsive to a first control signal for forming, on an adjacent portion of the image surface, a swath of pixels along a slew axis;

a pen holder for holding said printhead in a fixed stationary position relative to said housing, a print medium holder for movably holding said medium with different said portions of said image surface adjacent said printhead, such that said print medium extends outside the housing in the direction of the slew axis;

an advance motor and a slew motor, each having separate tracking means for tracking the position of the paper relative to the pen, and each being responsive to a respective control signal and mechanically coupled to the print medium holder for moving said print medium, relative to said housing, independently along said slew axis and along said advance axis; and a controller coupled to said pen and to said motor for supplying said first and second control signals to thereby form said image.

7. The printer of claim 6 wherein the tracking means comprises:

an advance tracking surface, which is interconnected to the advance motor and has readable positioning marks;

an advance sensor for reading the readable positioning marks and transmitting such to the controller;

a slew tracking surface, which is interconnected to the slew motor and has readable positioning marks; and a slew sensor for reading the readable positioning marks and transmitting such to the controller.

8. The printer of claim 7 wherein the advance tracking surface is a wheel.

9. The printer of claim 7 wherein the slew tracking surface is a wheel.

10. The printer of claim 1 wherein said print medium holder further comprises a paper holding crimp securing an edge of the print medium.

11. The printer of claim 1 wherein the print medium holder further comprises at least one set of opposing rollers, said rollers being pivotally mounted to the case.

12. The printer of claim 7 wherein the slew tracking surface and the slew sensor move laterally with the print medium holder relative to the housing when the print medium holder moves on the advance axis, and the advance tracking surface, advance sensor and pen do not move laterally relative to the housing.

13. A printer for printing an image on a sheet of a print medium, the print medium having an image surface on which the image may be formed, the printer comprising:

a housing;

at least one ink jet pen with an array of nozzle jets arranged to print a swath of pixels along a slew axis, said pen having a tip responsive to a first control signal for forming at least one image pixel on an adjacent pixel location of the image;

a pen holder for holding said pen inside the housing with said tip in a fixed position relative to the housing, a print medium holder at least partially inside the housing for movably holding said medium with different portions of said print surface adjacent said tip, the print medium extending outside said housing;

two motors, an advance motor and a slew motor, responsive to a second control signal and mechanically coupled to the print medium holder for moving said medium on two orthogonal axes relative to said tip, each motor having separate tracking means for tracking the position of the paper relative to the pen, said motors maintained in a stationary position relative to said housing.; and a controller coupled to the pen, motors and tracking means for reading tracking signals generated by said tracking means and in response thereto supplying said first and second control signals to thereby form said image.

14. A carriageless printer, comprising:

a housing having a small footprint configuration;

a stationary printhead mounted in said housing for depositing indicia forming material onto a sheet of print medium, said printhead including a nozzle array defining a nozzle axis;

a guide arrangement spaced from said printhead and movably mounted within said housing for holding said sheet of print medium in a fixed position relative to said guide arrangement; and a linear translational arrangement coupled to said guide arrangement for moving it and said sheet of print medium relative to said stationary printhead to permit the indicia forming material to be deposited onto said sheet of print medium as said sheet proceeds along an advance axis parallel to said nozzle axis and along a slew axis perpendicular to said nozzle axis, said slew axis extending between an extended right edge position partially outside of said housing and an extended left edge position partially outside of said housing.

15. A carriageless printer according to claim 14, wherein said guide arrangement includes:

a movable medium holder for supporting from below said sheet of print medium; and a securing arrangement mounted to said movable medium holder for holding said sheet of print medium in a fixed position to facilitate sheet printing purposes.

16. A carriageless printer according to claim 15, wherein said linear translational arrangement includes:

an advance arrangement for moving said medium holder along said advance axis parallel to said stationary printhead; and a slew arrangement for moving said medium holder along said slew axis perpendicular to said stationary printhead.

17. A carriageless printer according to claim 16 wherein said advance arrangement includes:

an advance motor for generating a rotational driving force; and an advance mechanism coupled to said advance motor for translating said rotational force into linear movement along said advance axis.

18. A carriageless printer according to claim 17, wherein said slew arrangement includes:

a slew motor for generating another rotational driving force; and a slew mechanism coupled to said slew motor for translating said another rotational force into rectilinear movement along said slew axis.

19. A carriageless printer according to claim 18, further comprising:

an advance axis sensing arrangement for determining the position of said movable medium holder relative to said stationary printhead and for generating an electrical signal indicative of the position of said medium holder on said advance axis;

a slew axis sensing arrangement for determining the position of said moveable medium holder relative to said stationary printhead and for generating another electrical signal indicative of the position of said medium holder on said slew axis; and a controller responsive to said electrical signal and said another electrical signal for controlling said advance motor and said slew motor to cause said medium holder to move in a desired path of travel relative to said stationary printhead to facilitate the depositing of the indicia forming material onto said sheet of print medium.

* * * * *